United States Patent [19]

Roberson

[11] 4,164,304

[45] Aug. 14, 1979

[54] CLOSURE FOR STEEL DRUMS WITH BLOW MOLDED LINERS

[75] Inventor: Carl Roberson, Park Forest, Ill.

[73] Assignee: The Continental Group, Inc., New York, N.Y.

[21] Appl. No.: 910,519

[22] Filed: May 30, 1978

[51] Int. Cl.[2] ..... B65D 25/20; B65D 51/20; B65D 55/02; B65D 41/04

[52] U.S. Cl. ..... 220/465; 220/214; 220/257; 220/258; 220/288; 220/304; 285/203

[58] Field of Search ..... 220/465, 256, 258, 304, 220/288, 257, 214; 215/330; 285/202, 203, 204

[56] References Cited

U.S. PATENT DOCUMENTS

| | | | |
|---|---|---|---|
| 1,526,375 | 2/1925 | Riegel | 220/304 |
| 1,956,135 | 4/1934 | Schmitz et al. | 220/304 X |
| 2,031,350 | 2/1936 | Evans | 285/204 |
| 2,050,942 | 8/1936 | Francis | 220/304 X |
| 2,137,999 | 11/1938 | Curtis | 220/257 |
| 2,156,540 | 5/1939 | Melrath | 220/257 |
| 2,245,298 | 6/1941 | Proctor | 285/203 X |
| 2,255,964 | 9/1941 | Blaho | 220/304 X |
| 2,746,486 | 5/1956 | Gratzmuller | 220/304 X |
| 2,772,037 | 11/1956 | Rieke | 220/304 X |
| 2,962,185 | 11/1960 | Starr et al. | 220/288 X |
| 3,122,261 | 2/1964 | Parish, Jr. et al. | 220/257 |
| 3,167,210 | 1/1965 | Carney, Jr. | 220/465 X |
| 3,189,072 | 6/1965 | Starr | 220/288 X |
| 3,405,837 | 10/1968 | Carpenter, Jr. | 220/258 |

FOREIGN PATENT DOCUMENTS

| | | | |
|---|---|---|---|
| 594521 | 3/1960 | Canada | 220/304 |

*Primary Examiner*—Allan N. Shoap
*Attorney, Agent, or Firm*—Charles E. Brown

[57] ABSTRACT

A drum having a blow molded liner wherein the liner has a neck which extends through an opening formed in a wall of the drum. A closure assembly is provided for association with the neck both to retain the neck relative to the drum and to close the neck. The closure assembly includes a retainer and a closure member, the retainer including inner and outer concentric walls joined in spaced relation by a bridging portion. The neck is threadedly engaged with the outer wall and is received between the two walls with a terminal portion of the neck being wedgedly deformed to assure a seal between the retainer and the neck. A seal is also provided between the closure assembly and the neck. The inner wall defines a dispensing opening and has threadedly engaged therein a closure element. A tamper indicating overcap covers the closure assembly. The closure assembly has an interlock with the drum wall surrounding the opening. The retainer inner wall also has an integral rupturable diaphragm preventing initial entry into the liner.

13 Claims, 7 Drawing Figures

FIG.1
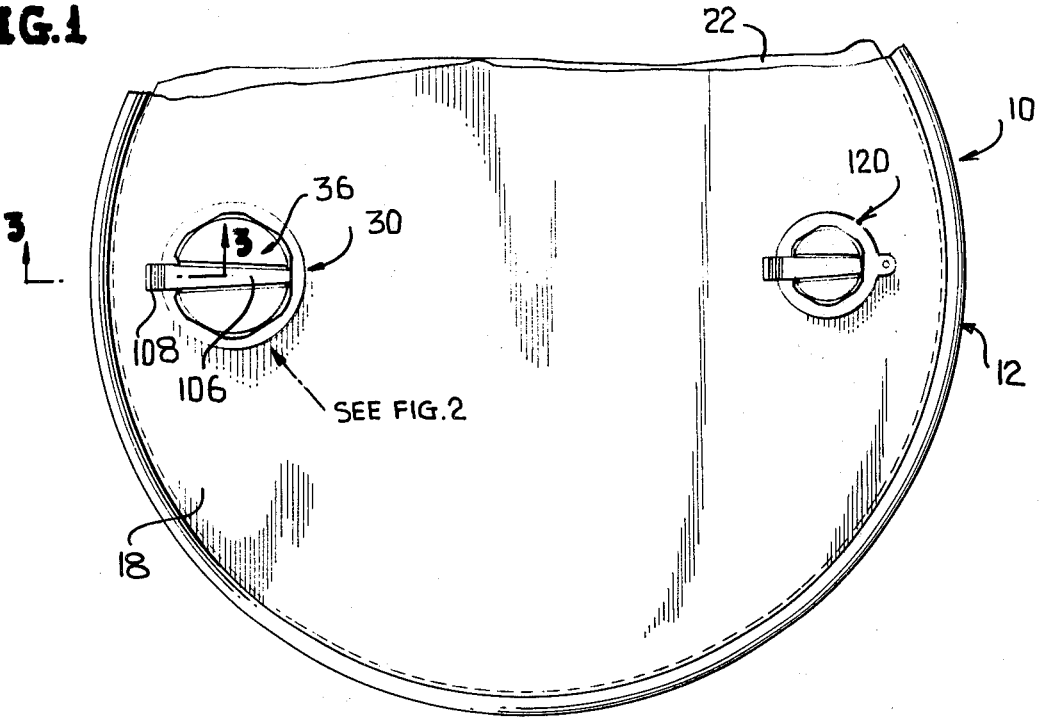
FIG.2
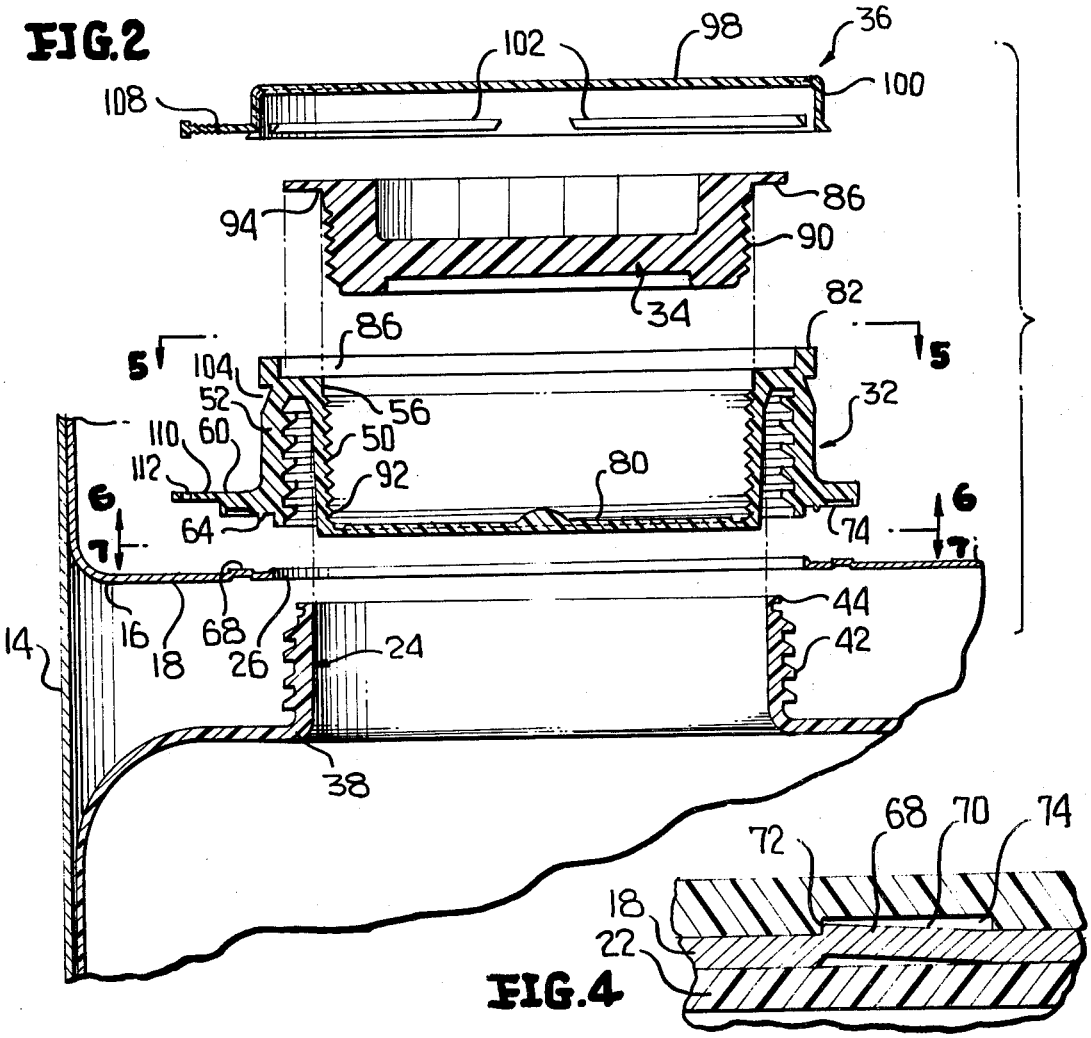
FIG.4

CLOSURE FOR STEEL DRUMS WITH BLOW MOLDED LINERS

This invention relates in general to new and useful improvements in drum assemblies, and more particularly to an improved closure assembly for use in conjunction with drums of the type having blow molded plastic liners.

It is known in the prior art by way of U.S. Pat. No. 3,405,837 to Carpenter to provide metal and other material drums with a plastic liner, the plastic liner being formed by blow molding and has a neck extending out through an opening formed in a wall of the drum. It is also known to provide a closure assembly which includes a retainer threadedly engaged with the liner neck for positioning the liner neck and forming a seal therewith with the retainer being internally threaded for removably receiving a plug. In accordance with this invention, there is first of all provided a specific relationship between a radially outer flange portion of the retainer and the drum wall surrounding the opening wherein the retainer is locked against rotation relative to the drum and also closes the opening in the drum wall with respect to the exterior. The retainer is constructed to have a seal with the exterior surface of the drum wall and also, because of its configuration and formation of a plastics material, may have embedded therein the burr which is normally formed in the forming of the opening in the drum wall. Further, the retainer has a projecting ring which extends into the opening and generally centers the retainer and the neck relative to the drum opening.

Further, the retainer is so constructed to form a seal with the neck. To this end the retainer includes an inner wall and an outer wall which are joined in spaced concentric relation by a bridging portion. The outer wall has an inner threaded surface releasably threadably engaged with an outer threaded surface of the neck so as to retain the neck in a fixed position relative to the drum. A terminal portion of the neck is formed so as to be radially outwardly deformable and the outer surface of the inner wall adjacent the bridging portion is flared so as to deform the neck deformable portion and form a seal therewith without there being contact between the neck terminal portion and the underside of the bridging portion.

In addition, the bridging portion is provided with a radially inner and axially terminal recess receiving a flange of the closure element when the closure element is threaded into the retainer to close the opening therethrough. The bridging portion has a radially inner and axially terminal corner which is engageable with a radius or angled corner between the flange of the closure element and the remainder of the closure element to form a seal therewith.

Finally, the retainer is provided with an overcap which has a snap interlocking engagement with the retainer and the overcap having a diametrically extending tear strip for rupturing the overcap to facilitate the removal thereof. The bridging portion of the retainer terminates in a ring which defines the recess receiving the closure element flange with this ring being in part defined by an outer annular notch which receives interlocking projections on a skirt of the overcap.

The interlock between the retainer flange and the drum wall is simply formed by partially punching the metal of the drum wall outwardly to define projections lying in a circle surrounding the opening in the drum wall. The projections have sloping outer surfaces thereby defining shoulders. The retainer flange has a plurality of openings formed in the underside thereof in the same general circular pattern as the projections for receiving individual ones of the projections.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a fragmentary top plan view of a drum formed in accordance with this invention, the drum having both a dispensing opening and a vent opening formed in accordance with this invention.

FIG. 2 is an enlarged fragmentary exploded vertical sectional view taken through the closure assembly of the larger drum opening and shows the general details of the components thereof.

FIG. 4 is an enlarged fragmentary vertical sectional view taken generally along the line 4—4 of FIG. 3 and shows the details of the interlock between the retainer of the closure assembly and the drum wall.

Figure 6:
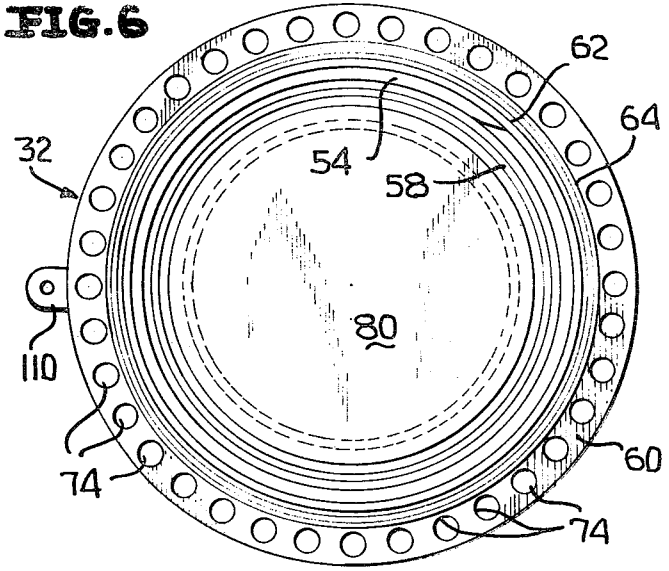
FIG. 6 is a bottom plan view of the retainer taken generally along the line 6—6 of FIG. 2, and shows further the details thereof.
Figure 7:
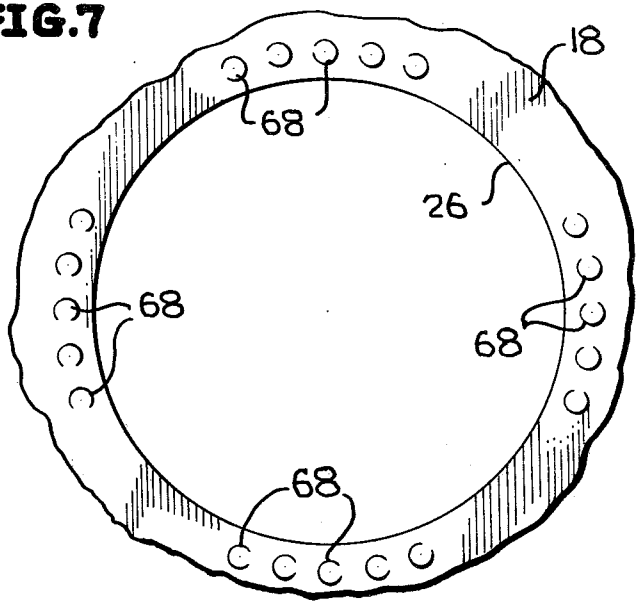
FIG. 7 is a fragmentary top plan view taken generally along the line 7—7 of FIG. 2, and shows the details of the container wall including the opening formed therein and the projections struck therefrom.

Referring now to the drawings in detail, it will be seen that there is illustrated a drum unit which is generally identified by the numeral 10 and includes a drum 12 which is generally of a conventional construction. Most specifically, the drum 12 includes a body 14 and an end 16 with the end 16 including an end wall 18. The end 16 is joined to the body 14 by a conventional seam 20.

It is to be understood that the drum 12 may be of varying construction and that the body 14 could be formed of metal or could be formed of a fiber material. In like manner, the end 16 could be formed of various materials although in most instances it will be formed of metal.

The drum 12 is provided with an internal liner 22 which is preferably formed of a blow molded plastics material. The liner 22 is provided with a neck, generally identified by the numeral 24, which is preferably integrally formed. The neck 24 extends axially outwardly through an opening 26 formed in the wall 18 such as by a conventional shearing operation. When the end 16 is formed of metal, the shearing operation for forming the opening 26 normally results in an axially projecting burr 28 surrounding the opening. The direction of shearing to form the opening 26 is such that the burr 28 projects outwardly of the drum 12. This is a preferred relationship since an inward projection of the burr 28 would cut the liner 22.

In order to provide the combined functions of securing the neck in position, centering the neck, defining a dispensing opening through the neck, and closing the dispensing opening, there is provided a closure assembly, generally identified by the numeral 30. The closure assembly 30 includes a retainer, generally identified by the numeral 32, and a closure element, generally identified by the numeral 34. There is also provided an overcap generally identified by the numeral 36.

Considering first the details of the neck 24, it will be seen that the neck 24 is joined to the remainder of the liner 22 by means of an arcuate portion 38. The neck 24 is configurated to define an inner opening 40 therethrough. The outer surface of the neck 24 is primarily in the form of exterior threads 42. Axially outwardly of the threads 42, the neck 24 is configurated to define a deformable portion 44 which includes a terminal lip 46 defined in part by an outer annular recess 48.

The retainer 32 is of a double wall construction and includes an inner wall 50 and an outer wall 52 which are generally cylindrical and are disposed in radially spaced generally concentric relation. The outer wall 52 has an inner surface in the form of threads 54 which are shaped to cooperate with the threads 42. The threads 42, 54 are preferably of the buttress type so as to provide wide mating surfaces.

It is to be noted that the walls 50, 52 are radially spaced to have received therebetween the neck 24 and are joined at their outer ends by a bridging portion 56 which rigidifies the axially outer portions of the walls 50, 52.

The outer surface of the inner wall 50 adjacent the bridging portion 56 is flared as at 58 and when the retainer 32 is fully engaged with the neck 24, the flared portion 58 engages the inner surface of the deformable portion 44 and radially outwardly deforms the same, while at the same time forming a tight seal between the neck and the wall 50.

A radially outwardly directed flange 60 carried by the outer wall 52 engages the wall 18 of the drum. The flange 60 is disposed remote from the bridging portion 56 and is integrally formed with the wall 52.

The flange 60 and an adjacent portion of the wall 52 perform several functions. First of all, there is an inner projecting ring 62 which extends down through the opening 26 and generally serves to center the retainer 32 relative to the opening 26.

Next, since the retainer 32 is formed of a deformable plastics material, the burr 28 of the wall 18 becomes embedded into the retainer 32 so as to prevent any accidental injury to either the liner 22 or one handling the drum.

Figure 3:
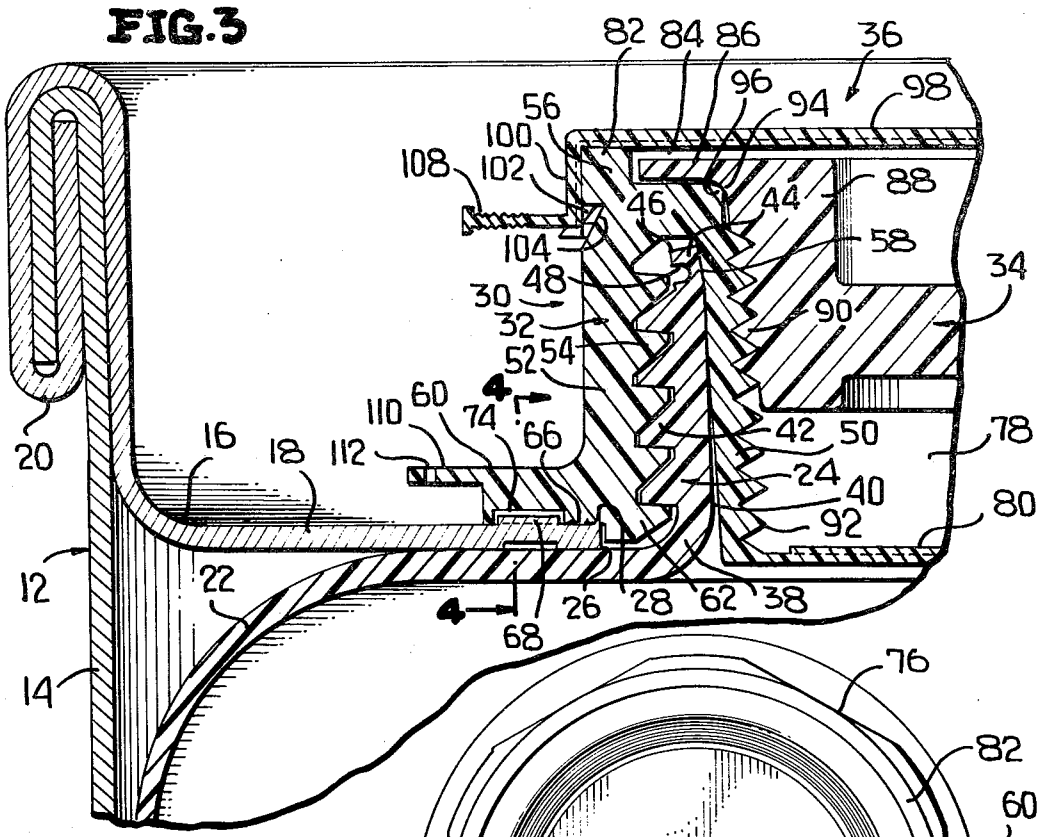
FIG. 3 is an enlarged fragmentary vertical sectional view taken along the line 3—3 of FIG. 1, and shows specifically the utilization of a closure assembly for securing in place a neck of the liner relative to the drum and for closing the opening defined by the retainer.

Radially outwardly of the position of the burr 28, as is best shown in FIG. 2, the flange 60 is provided with a depending annular rib 64 which engages the outer surface of the wall 18 surrounding the opening 26 and forms a seal between the flange 60 and the wall 18 as at 66 in FIG. 3.

The proportions of the retainer 32 and the neck 24 and the angle of the flared portion 58 is such that as the retainer 32 is being threaded on the neck 24, the seal between the flared portion 58 and the neck inner surface will be achieved prior to or at the same time as the rib 64 seals on the wall 18. Relative movement between the neck 24 and the retainer 32 will be limited by the engagement of the rib 64 and possibly the flange 60 with the wall 18 so that the terminal end of the neck 24 does not come into contact with the bridging portion 56 of the retainer 32.

Finally, the flange 60 is configurated to form an interlock with the wall 18 so as to resist rotation of the retainer 32 in a releasing direction. To this end, the drum wall 18 surrounding the opening 26 is provided with groups of axially outwardly directed projections 68. Each projection 68 is formed by partially striking the metal of the wall 18 axially outwardly as is shown in FIG. 4. Thus, each projection 68 has a sloping outer surface 70 and an upstanding shoulder 72.

The projections 68 are preferably, although not limited to, of a circular configuration. Such a configuration may be readily punched with conventional tooling. All of the projections 68 lie along a common circle disposed concentric to the opening 26.

As is best shown in FIG. 6, the underside of the flange 60 is provided with a continuous series of recesses 74. The recesses 74 lie along the same circle radius as the projections 68 and are circumferentially spaced the same as the spacing of the projections 68 in the groups. The recesses 74 will also be circular in outline when the projections 68 are circular.

Figure 5:
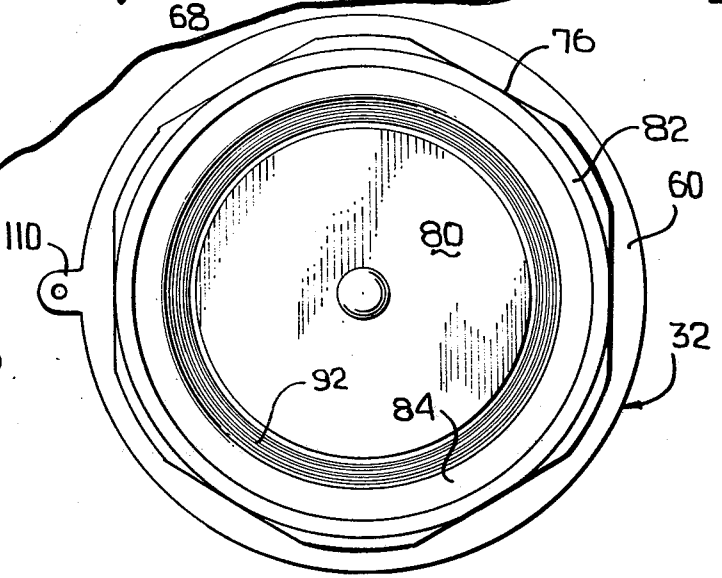
FIG. 5 is a top plan view of the retainer taken generally along the line 5—5 of FIG. 2, and shows the specific details thereof.

In order to facilitate the rotation of the retainer 32 relative to the neck 24 and the drum 12, the exterior of the wall 52 axially beyond the flange 60 is provided with a tool engaging surface 76 as is best shown in FIG. 5. Although the illustrated tool engaging surface 76 includes flats for engagement by a wrench, it is to be understood that other types of tool engaging surfaces, including those specially required for engagement by a spanner, may be provided.

It will be readily apparent from FIG. 3 that when the retainer 32 is properly positioned relative to the neck 24 and the drum 12, the retainer will be locked to the drum wall 18 against rotation, will be centered relative to the opening 26, will be sealed relative to the wall 18, and will have embedded therein the burr 28. At the same time, the retainer 32 will have an effective seal with the neck 24. The retainer by way of the inner wall 50 will also define a dispensing opening 78. The dispensing opening 78 will normally be closed by a removable diaphragm 80 extending across the axially inner end of the wall 50 although the diaphragm 80 may be optional.

It will be seen that the bridging portion 56 has an axial extension in the form of a ring 82 which defines a radially inner and axially terminal recess 84 which receives a flange 86 of the closure element 34. The closure element 34 includes a body 88 which is provided with external threads 90 engaged with threads 92 on the inner surface of the inner wall 50. The closure element 34 may be in the form of any conventional plug and preferably has a rounded, or optionally angle, corner 94 between the body 88 and the flange 86. The bridging portion 56 has a radially inner axially terminal corner 96 which is engageable with the corner 94 and is deformable to form a positive seal between the retainer 32 and the closure element 34.

The overcap is preferably formed of a plastics material and includes an end wall 98 and a skirt 100. The skirt 100 has formed on a radially inner surface thereof a projecting rib or ribs 102 which snap into an annular notch 104 formed in the radially exterior surfaces of the bridging portion 56. The notch 104 in part defines the ring 82.

With reference to FIG. 1, it will be seen that the overcap 36 is of the rupturable type and includes a diametrical tear strip 106 which extends down the skirt 100 and terminates in a pull tab 108.

Finally, when desired, the flange 60 may be provided with an ear 110 having an aperture 112 therethrough for receiving in a conventional manner a tag wire in the normal manner.

The drum unit 10 also includes a vent opening in addition to the dispensing opening. The vent opening is formed in the same manner as that described with respect to the dispensing opening and includes a closure assembly 120 which may be identical to the closure assembly 30.

Although only a preferred embodiment of the closure assembly and overcap has been specifically illustrated and described, it is to be understood that minor variations may be made therein and the relationship thereof to the drum and liner neck without departing from the spirit and scope of the invention as defined by the appended claims.

I claim:

1. In combination with a drum having a molded liner, a closure assembly, said drum having a wall with an opening therethrough, said liner having a neck portion extending through said opening, and said closure assembly being disposed externally of said drum and engaging said liner neck portion, said closure assembly comprising a retainer and a closure element, said retainer having inner and outer radially spaced concentric walls joined at outer ends thereof by a bridging portion, said neck being telescoped between said inner and outer walls, completmentary threads on said neck and said outer wall securing said retainer on said drum and said liner, said inner wall being internally threaded, and said closure element being removably threadedly engaged within said inner wall, said outer wall having a radially outwardly directed annular flange remote from said bridging portion and opposing said drum wall surrounding said opening, said drum wall having upstanding projections arranged in spaced relation in a circular pattern around said opening, said projections being struck from said drum wall and having sloping upper surfaces terminating in shoulders, said drum wall being imperforate in the area of said projections and said drum wall having an inner surface with indentations therein generally corresponding to said projections, and said flange having an underside provided with recesses arranged in similar spaced relation in a like diameter circular pattern with said recesses receiving said projections to lock said retainer against releasing rotation relative to said drum wall.

2. The combination of claim 1 wherein said projections and said recesses are of circular outline.

3. The combination of claim 1 wherein said projections are arranged in spaced groups and said recesses are continuously arranged.

4. The combination of claim 1 wherein said outer wall above said flange has an outer surface including tool receiving areas above said flange for facilitating the rotation of said retainer relative to said drum.

5. The combination of claim 1 wherein said opening is a sheared opening and said drum wall has a burr projecting therefrom surrounding said opening, said retainer is formed of a plastics material and said burr is embedded in said flange.

6. The combination of claim 1 wherein said flange has an inner projecting ring extending into said opening.

7. The combination of claim 1 wherein said flange has an integral sealing ring directly engaging said drum wall radially inwardly of said projection and forming a seal between said drum wall and said retainer flange surrounding said opening and radially within said projections.

8. In combination with a drum having a molded liner, a closure assembly, said drum having a wall with an opening therethrough, said liner having a neck portion extending through said opening, and said closure assembly being disposed externally of said drum and engaging said liner neck portion, said closure assembly comprising a retainer and a closure element, said retainer having inner and outer radially spaced concentric walls joined at outer ends thereof by a bridging portion, said neck being telescoped between said inner and outer walls, complementary threads on said neck and said outer wall securing said retainer on said drum and said liner, said inner wall being internally threaded, and said closure element being removably threadedly engaged within said inner wall, said outer wall having a radially outwardly directed annular flange remote from said bridging portion and opposing said drum wall surrounding said opening, said opening being a sheared opening with said drum wall having an annular burr projecting therefrom surrounding said opening, said retainer being formed of a plastics material with said burr being embedded in said flange.

9. The combination of claim 8 wherein said flange has an inner projecting ring extending into said opening.

10. The combination of claim 8 wherein said flange has an integral sealing ring directly engaging said drum wall and forming a seal between said drum wall and said retainer flange surrounding said opening.

11. In combination with a drum having a molded liner, a closure assembly, said drum having a wall with an opening therethrough, said liner having a neck portion extending through said opening, and said closure assembly being disposed externally of said drum and engaging said liner neck portion, said closure assembly comprising a retainer and a closure element, said retainer having inner and outer radially spacec concentric walls joined at outer ends thereof by a bridging portion, said neck being telescoped between said inner and outer walls, complementary threads on said neck and said outer wall securing said retainer on said drum and said liner, said inner wall being internally threaded, and said closure element being removably threadedly engaged within said inner wall, said outer wall having a radially outwardly directed annular flange remote from said bridging portion and opposing said drum wall surrounding said opening, said neck having a cylindrical inner surface, said neck having a radially outwardly deformable free end portion adjacent the threads of said neck remote from said opening, said free end portion forming part of said cylindrical inner surface, and said inner wall having a flared radially outer surface portion and solely engaging said cylindrical inner surface of said deformable portion and forming a seal therewith.

12. The combination of claim 11 wherein said deformable portion includes a terminal lip defined by a radially outer undercut.

13. The combination of claim 11 wherein said retainer is radially recessed between said outer wall threads and said bridging portion for receiving said deformable portion when deformed by said flared portion.

* * * * *

UNITED STATES PATENT AND TRADEMARK OFFICE

CERTIFICATE OF CORRECTION

PATENT NO. : 4,164,304

DATED : August 14, 1979

INVENTOR(S) : Carl Roberson

It is certified that error appears in the above–identified patent and that said Letters Patent are hereby corrected as shown below:

Claim 1, line 9, after "neck" insert --portion--; line 11, after "neck" insert --portion--.

Claim 8, line 9, after "neck" insert --portion--; line 11, after "neck" insert --portion.

Claim 11, line 8, change "spacec" to --spaced--; line 10, after "neck" insert --portion--; line 11, after "neck" insert --portion--; line 18, after "neck" insert --portion--; line 19, after "neck" insert --portion--.

Signed and Sealed this

*Eleventh* Day of *December 1979*

[SEAL]

*Attest:*

SIDNEY A. DIAMOND

*Attesting Officer*

*Commissioner of Patents and Trademarks*